US009901179B2

(12) United States Patent
Buchholz

(10) Patent No.: US 9,901,179 B2
(45) Date of Patent: Feb. 27, 2018

(54) PIECE OF SEATING FURNITURE HAVING A PIVOTABLE FUNCTIONAL PART

(71) Applicant: Ferdinand Lusch GmbH & Co. KG, Bielefeld (DE)

(72) Inventor: Christian Buchholz, Gutersloh (DE)

(73) Assignee: Ferdinand Lusch GmbH & Co. KG, Bielefeld (DE)

( * ) Notice: Subject to any disclaimer, the term of this patent is extended or adjusted under 35 U.S.C. 154(b) by 105 days.

(21) Appl. No.: 14/961,157

(22) Filed: Dec. 7, 2015

(65) Prior Publication Data

US 2016/0157613 A1 Jun. 9, 2016

(30) Foreign Application Priority Data

Dec. 8, 2014 (DE) ..... 10 2014 118 163

(51) Int. Cl.

| | |
|---|---|
| ***A47C 7/00*** | (2006.01) |
| ***A47C 1/02*** | (2006.01) |
| ***A47C 1/027*** | (2006.01) |
| ***A47C 1/03*** | (2006.01) |
| ***A47C 7/38*** | (2006.01) |
| ***A47C 7/50*** | (2006.01) |

(52) U.S. Cl.

CPC ..... *A47C 7/00* (2013.01); *A47C 1/02* (2013.01); *A47C 1/027* (2013.01); *A47C 1/03* (2013.01); *A47C 7/38* (2013.01); *A47C 7/506* (2013.01)

(58) Field of Classification Search

None

See application file for complete search history.

(56) References Cited

U.S. PATENT DOCUMENTS

| | | | | |
|---|---|---|---|---|
| 3,737,136 A * | 6/1973 | Snurr | ..... | A47B 9/083 108/147.19 |
| 3,951,238 A * | 4/1976 | Dent | ..... | F16B 7/1409 16/82 |
| 4,150,803 A * | 4/1979 | Fernandez | ..... | B64C 13/04 244/135 A |
| 4,188,062 A * | 2/1980 | Rogers, Jr. | ..... | A47C 1/037 297/403 |

(Continued)

FOREIGN PATENT DOCUMENTS

| | | |
|---|---|---|
| AT | 008579 U1 | 10/2006 |
| DE | 10236158 A1 | 2/2004 |

(Continued)

*Primary Examiner* — David E Allred

(74) *Attorney, Agent, or Firm* — The Webb Law Firm

(57) ABSTRACT

A piece of seating furniture having at least one base body, at least one adjustable functional part, at least one pivot fitting for adjusting the functional part relative to the base body and a separate, lift setting mechanism for locking the functional part in relation to the base body. The lift setting mechanism has a guide and a slender bar which can be moved in relation to the guide. The lift setting mechanism can be moved from a set position, blocking the adjustment of the functional part, to a reset position, unblocking the adjustment of the functional part. The pivoted lever is pivotably connected to the base body separately via two adjusting levers, the two adjusting levers are jointly connected to the base body via a control lever and one adjusting lever is pivotably connected to the base body via a guide lever.

14 Claims, 10 Drawing Sheets

(56) References Cited

U.S. PATENT DOCUMENTS 4,601,246 A * 7/1986 Damico ..... A47B 9/083 108/146
5,626,389 A * 5/1997 Logan, Jr. ..... A61G 5/14 297/250.1
6,644,748 B2 * 11/2003 Tholkes ..... A47B 9/00 248/280.11
6,702,372 B2 * 3/2004 Tholkes ..... A47B 9/00 297/172
6,726,279 B1 * 4/2004 Figel ..... A61G 5/006 297/340
6,846,042 B2 * 1/2005 Hanson ..... A61G 5/006 297/115
7,004,542 B2 * 2/2006 Saint-Jalmes ..... A47C 7/024 297/284.11
7,322,641 B2 * 1/2008 Ekornes ..... A47C 1/036 297/61
7,594,693 B2 * 9/2009 Ekornes ..... A47C 1/036 297/61
8,146,999 B2 * 4/2012 Ferguson ..... B64C 11/065 297/411.35
8,151,387 B2 * 4/2012 Osborne ..... A61G 7/00 5/610
9,603,453 B2 * 3/2017 Hoffman ..... A47C 1/0355
2001/0035668 A1 * 11/2001 Gaffney ..... A47C 1/0345 297/85 M
2004/0108764 A1 6/2004 Rauschenberger et al.
2014/0265497 A1 * 9/2014 Hough ..... A61G 5/14 297/316
2014/0265502 A1 * 9/2014 Hough ..... A61G 5/14 297/344.12
2014/0292052 A1 * 10/2014 Parker ..... A47C 7/38 297/342

FOREIGN PATENT DOCUMENTS

DE 202005014692 U1 12/2005
DE 202012009798 U1 1/2013
DE 102012006235 A1 9/2013
DE 202013004428 U1 10/2013
EP 2893843 A1 7/2015

* cited by examiner

PIECE OF SEATING FURNITURE HAVING A PIVOTABLE FUNCTIONAL PART

CROSS-REFERENCE TO RELATED APPLICATION

This application claims priority to German Patent Application No. 10 2014 118 163.8 filed Dec. 8, 2014, the disclosure of which is hereby incorporated in its entirety by reference.

BACKGROUND OF THE INVENTION

Field of the Invention

The invention relates to a piece of seating furniture, preferably an armchair or a sofa, having at least one base body, preferably a back rest, a seat or a support frame, at least one adjustable functional part, preferably a head part, a foot part or an arm rest, at least one pivot fitting for adjusting the functional part relative to the base body and an, in particular separate, lift setting mechanism for locking the functional part in relation to the base body, wherein the lift setting mechanism has a guide and a slender bar which can be moved in relation to the guide, wherein the lift setting mechanism can be moved from a set position, blocking the adjustment of the functional part relative to the base body in a load direction in a plurality of positions in a form-fit and/or wedging manner, to a reset position, unblocking the adjustment of the functional part relative to the base body in the load direction from at least one position, and back, wherein the functional part is supported by a pivoted lever of the pivot fitting.

Description of Related Art

Seating furniture, for example in the form of sofas or armchairs, having functional parts which are pivotable in relation to a base body is known in various designs and enables the user of the seating furniture to take up a comfortable sitting and/or reclining position. Head parts, which are also referred to as head rests, foot parts or arm rests in particular qualify as functional parts. All seating furniture bodies with respect to which the functional part can be adjusted are considered as base bodies. In particular, those bodies which are not themselves adjusted qualify as base bodies, although this is not mandatory. The base body can, for example, be a back rest, a seat or a support frame, in which the seat and/or the back rest can be held. Instead of a support frame, a chassis is also possible, which can form a support frame together with attachment parts, for example in the form of side parts.

The user of the seating furniture can rest his or her head comfortably against the head part, put his or her feet or legs comfortably on the foot part or rest his or her arms comfortably on the arm rests. A possible motor-driven adjustment of the head part in relation to the back rest further increases the comfort for the user of the seating furniture. In addition, the functional part can be held firmly in each position.

Seating furniture has so-called pivot fittings for adjusting the functional part, these pivot fittings enabling the functional part to be purposefully adjusted in relation to the base body. The pivot fittings have at least one pivoted lever which at least partly supports the functional part.

In some cases, so-called lift setting mechanisms are used to ensure that the functional part can be correspondingly set and, at the same time, locked in the desired position. Lift setting mechanisms comprise a guide, for example in the form of a housing, and a slender bar which can be moved or can be pulled out in relation to the guide. The slender bar and the guide are preferably essentially linearly connected together. In addition, the slender bar carries a spring-loaded latching element which, as a result of the spring force when the slender bar is pulled out, latches or can latch into receiving slots provided along the guide for this purpose. The receiving slots and the latching element are adapted to one another such that the slender bar after latching into a receiving slot cannot be moved in the opposite direction again along the guide or cannot be pushed in again into the guide which possibly is in the form of a housing. This is prevented by the form-fit engagement of the latching element with the corresponding receiving slot. A further movement or withdrawal of the slender bar can, however, take place from the same position without any problems. In order to be able to bring the slender bar into the starting position again, the slender bar has to be firstly moved or pulled out as far as to an end position. The latching element is blocked, so that when the slender bar is pushed back, for example into the housing, it cannot engage with the receiving slots. When the slender bar is pulled out again in relation to the guide, or out of the housing, the latching element is, however, activated again and consequently latches again, at least potentially, successively into the receiving slots.

By means of the previously described blocking of a movement of the slender bar and, as required, the unblocking of this movement, the lift setting mechanism also blocks the movement of the functional part, namely preferably in a load direction. This arises when there is a normal application of load to the functional part by the user according to specifications. By coupling the functional part and the base body to the pivot fitting and the lift setting mechanism, the movement of the slender bar in relation to the guide of the lift setting mechanism is accompanied by an adjustment of the functional part in relation to the base body, and vice versa.

The disadvantage of the known seating furniture is the high amount of effort required in terms of design. This particularly applies for seating furniture which is to be designed such that it is very robust, so that even irregular use, for instance by playing children, can be withstood without any problems.

SUMMARY OF THE INVENTION

Therefore, the present invention is based on the object of developing and enhancing the seating furniture of the type mentioned in the introduction and previously described in detail in such a way that simpler manufacture of a robust functional part adjustment is possible.

This object is achieved in the case of a piece of seating furniture according to the present disclosure by the fact that the pivoted lever is pivotably connected to the base body separately via two adjusting levers, that the two adjusting levers are jointly connected to the base body via a control lever and that additionally one adjusting lever is pivotably connected to the base body via a guide lever.

Connecting the pivoted lever to the base body via the two adjusting levers allows the pivoted lever to be pivoted and supported stably with respect to the base body. The pivoted lever can be easily pivoted by moving the two adjusting levers differently, in particular by raising or lowering them. For this purpose, the two adjusting levers can be fixed to the control lever spaced apart from one another, in particular in the longitudinal direction of the control lever. Pivoting the control lever then namely results in the adjusting levers being pivoted correspondingly differently relative to one another.

In order to be able to move the adjusting levers relative to one another in a predetermined way, the two adjusting levers are connected to the base body via a common control lever. Additional degrees of freedom can also be prevented when adjusting the pivot fitting if one of the adjusting levers is connected to the base body via the guide lever. Hence, for each position of the functional part, when it is adjusted from the pivoted back position into the pivoted up position and back again, just one position of the pivot fitting results in each case (degree of freedom 1).

Ultimately, in addition to the pivoted lever, only four other simple levers are required, which can be connected together in a simple way. In this way, the adjustment of a functional part can be obtained which is very robust and is less liable to malfunction.

The functional part, which is preferably a head part, can, by means of the relative adjustment of the adjusting levers against one another, on the one hand, be moved upwards or downwards and, on the other hand, at the same time can be pivoted backwards or forwards. Adjusting a functional part, for example in the form of a head part, an arm rest or a foot part, upwards and forwards or inwards or outwards into a pivoted up position leads to an elongation of the upholstery section which is more strongly bent round in the pivoted back position of the functional part. The adjustment inwards or outwards is particularly suitable when adjusting arm rests. This allows the functional part to be adjusted without creasing of the upholstery occurring. Merely pivoting the functional part from a position which is angled with respect to the base body into an elongated position would, if the base body and the functional part are upholstered together, lead to creasing of the upholstery material which is excess in this position. In particular, a back rest, a seat or a frame or frame part, for example in the form of a side part, qualify as base bodies.

With respect to the pivot fitting, apart from the adjusting levers, the pivoted lever, the control lever and the guide lever, further levers can be dispensed with, in order to simplify the pivot fitting and reduce the production costs. However basically, as required, other components can also be integrated into the pivot fitting.

In a first preferred embodiment of the piece of seating furniture, the lift setting mechanism has a latching element which interacts with at least one receiving slot, in particular with a plurality of receiving slots. The plurality of receiving slots is then chosen such that the latching element in different positions of the slender bar in relation to the guide of the lift setting mechanism can in each case latch into a receiving slot. The latching element is in particular spring-loaded, in order to support latching into the at least one receiving slot. The latching element forms a latching connection by engaging with a receiving slot, this latching connection blocking the adjustment of the slender bar in relation to the guide or of the functional part in relation to the base body in one direction, in particular the load direction, in a form-fit manner. In the case of a plurality of receiving slots, the position of the slender bar of the lift setting mechanism can be locked in different positions, in any case in one direction of movement of the slender bar in relation to the guide. From a design point of view, it is also preferred if the at least one receiving slot is provided in the guide, in particular in the form of a housing, and the at least one latching element is provided on the slender bar.

Furthermore, the latching element can be deactivated, so that the slender bar can be adjusted in relation to the guide without blocking, that is to say, in particular so that the functional part can be adjusted in the load direction in relation to the base body. Deactivation is caused by moving the slender bar in relation to the guide into an end position. The latching element can then, for example, be held in a retracted position, in which the latching element is unable to engage with the at least one receiving slot. In addition, by moving the slender bar in relation to the guide into another end position, the latching element can be activated again, so that the latching element can latch into the at least one receiving slot again. In the deactivated position of the latching element, the slender bar can therefore be moved back into a direction in which movement of the slender bar in the activated position is prevented.

In terms of the functionality, it is particular preferred if the lift setting mechanism has at least one wedge element which is movable between a wedging position and an adjustment position in relation to the slender bar. In the wedging position the wedge element can be held wedged in a wedge gap between the slender bar and the guide, in particular in the form of a housing, so that movement of the slender bar in relation to the guide in one direction is prevented. This direction is preferably the direction in which the slender bar is loaded when the functional part is subjected to a normal load according to specifications. This can be brought about by the user resting his or her head against the head part, by putting his or her legs onto the foot part or by supporting his or her arms on the arm rests. By wedging the wedge element in the wedge gap, the functional part with a partial displacement cannot be moved back towards a starting position. In the adjustment position, the wedge element is not wedged in the wedge gap. The slender bar can therefore be moved in one direction in relation to the guide. In the opposite direction, however, this is only partially possible. That is to say, the wedge element already after very little travel along the adjustment path reaches far enough into the wedge gap that the wedge element is held wedged in the wedge gap and a further adjustment of the slender bar in this direction is blocked. Finally, a quieter and more precise adjustment of the functional part in relation to the base body can be obtained by means of this wedging. A configuration of the lift setting mechanism, which is simple in terms of design and, at the same time, is functional, is obtained if the wedge gap tapers in one direction and/or if the wedge element is wedged in the wedging position between a tapered end of the slender bar and the guide. As a consequence, more elaborate configurations of the lift setting mechanism, which would be vulnerable to malfunctions, are not needed. The wedge gap also tapers contrary to the direction in which wedging of the slender bar is effected. In addition, it is preferred if the wedging forces are great enough for the slender bar to be solidly wedged in the corresponding direction, namely, also in the case of force effects resulting from irregular use.

A wedge carriage can be provided, in order to simplify and ensure the movability of the wedge element in relation to the slender bar from the adjustment position into the wedging position and back, this wedge carriage comprising the at least one wedge element and also being movable in relation to the slender bar. The movable coupling of the slender bar and the wedge carriage can be ensured in a simple manner by means of an elongated hole provided in the slender bar, wherein the wedge carriage engages with the elongated hole.

In order to hold the wedge element securely in the adjustment position and correspondingly enable free adjustment without blocking, a detachable connection is provided between the slender bar and the wedge element and/or the wedge carriage. The detachable connection, without separate operation, by moving the slender bar in relation to the guide into a connection position can be locked in a wedging and/or latching manner. For the sake of simplicity and reliability, this in particular takes place by abutting the wedge element and/or the wedge carriage on an end stop.

The wedge element and/or the wedge carriage can abut at least in sections in a frictionally engaged manner on the guide. If the slender bar is successively moved in opposite directions in relation to the guide, the wedge element and/or the wedge carriage during the change in direction of the slender bar initially remains in a position which leads to a relative movement of the wedge element and the guide. As a result of this, the at least one wedge element is wedged in the wedge gap or is moved from a wedged position into a non-wedging position.

In one particularly preferred embodiment of the lift setting mechanism, the slender bar is essentially continuously adjustable and/or wedgable along the guide. Since the wedging blocking of the lift setting mechanism does not require any receiving slots, which in each case have to have a considerable minimum gap between them, the wedge element can basically be wedged along the entire adjustment path of the lift setting mechanism in the wedge gap between the slender bar and the guide.

The pivoted lever is preferably pivotably held on a pivot fitting about a notional pivot axis, wherein the pivot axis is preferably a rotational axis. This pivot axis results when the purely pivoting movement component of the pivoted lever when adjusting the functional part, i.e. without the lifting, lowering and moving of the functional part forwards or backwards, is considered. Since the pivoting movement component of the pivoted lever is caused by the adjusting levers, it is preferred if the notional pivot axis is provided approximately centrally between the contact points of the adjusting levers on the pivoted lever. As a result, in a simple way in terms of design, the functional part can be suitably pivoted, which, as required, enables the height of the functional part to be adjusted at the same time, without this requiring a disproportionately high amount of effort in terms of design.

From the design point of view and in order to ensure that the functional part is pivoted in a suitable manner, it is appropriate if the guide lever, the control lever, the adjusting lever, which is connected to the guide lever, and a support plate, to which the guide lever and the control lever are fixed, form a four-link chain. Corresponding four-link chains can also be formed quite robustly. For the same reasons, it is alternatively or additionally preferred if the two adjusting levers, the control lever and the pivoted lever form a four-link chain.

In order to keep the design effort for the piece of seating furniture low and ensure that heavy forces applied by a user to the functional part are dissipated, the lift setting mechanism, in particular the slender bar or the guide, which can also be formed as a housing, can come into contact with an adjusting lever. It is further appropriate, for the sake of simplicity, if the lift setting mechanism is connected to the adjusting lever. Alternatively or additionally, the lift setting mechanism can also come into contact with the functional part and/or the base body. In particular, the respectively simpler arrangement in terms of design can be preferred.

The two adjusting levers can be arranged essentially in one plane, in order to save construction space and dissipate forces over the pivot fitting well. Alternatively or additionally, for the same reasons, it is also preferred if the guide lever and the control lever are arranged essentially in one plane. Of course, the corresponding components due to their spatial dimensions do not, in fact, have to be completely arranged in one plane. However, the components can be arranged close to a common plane or can be provided at least partly in one plane. This is preferably meant with the arrangement essentially in the same plane.

A pivot fitting, which comprises at least the adjusting lever, the pivoted lever, the guide lever and the control lever, preferably has a degree of freedom of 1 with regard to the adjustment of the functional part from a pivoted back position to a pivoted up position and back. Hence, each position of the functional part defines just one position of the pivot fitting over the entire adjustment range of the functional part.

Pivot connections, in particular in the form of pivot joints, are simple and can absorb or transfer great forces. Therefore, in the present case, it is preferred if the one adjusting lever is connected to the pivoted lever, to the control lever and/or to the guide lever in each case via a pivot joint. Alternatively or additionally, for the same reasons, the other adjusting lever can be connected to the pivoted lever and/or to the guide lever in each case via a pivot joint.

The piece of seating furniture can be further simplified by the guide lever and the control lever being held on the base body by means of a common support plate. It is also preferred if the slender bar of the lift setting mechanism is connected to an adjusting lever and the guide of the lift setting mechanism is connected to guide lever. The lift setting mechanism could also be integrated into the pivot fitting as a lever. However, for functional reasons and for ease of maintenance and repair, it is preferred if the pivot fitting for adjusting the functional part and the lift setting mechanism for locking the functional part are formed separately. In addition, the slender bar and/or the guide of the lift setting mechanism can be connected to the functional part and/or to the base body instead of to the pivot fitting.

BRIEF DESCRIPTION OF THE DRAWINGS

The invention is explained in more detail below with the aid of the figures illustrating just one exemplary embodiment.

DETAILED DESCRIPTION OF THE INVENTION

Figure 1:
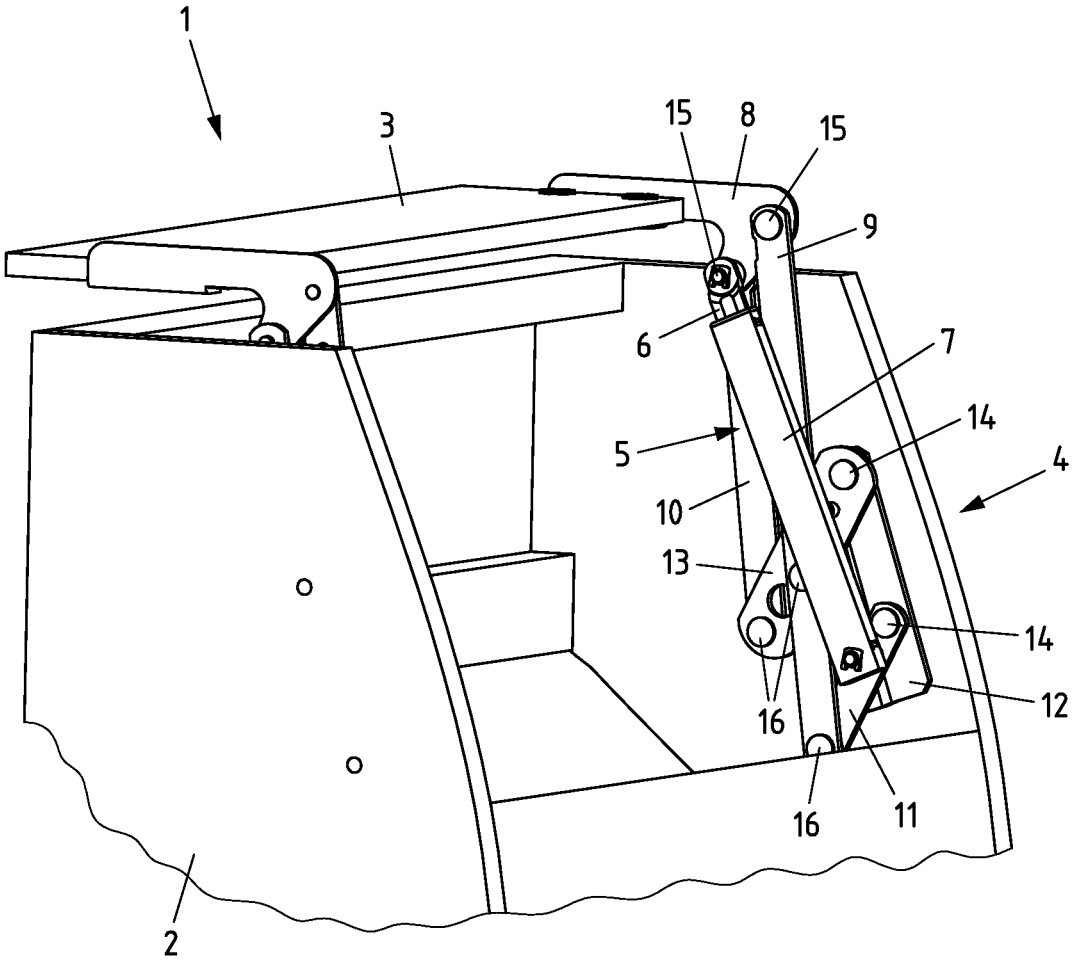
FIG. 1 shows a detail of a piece of seating furniture according to the invention with a head part in a pivoted back position without upholstery in a perspective view.

The inner structure of a piece of seating furniture 1, in the form of an armchair, is illustrated in FIG. 1. The piece of seating furniture 1 has a base body 2, in the form of a back rest, and a functional part 3, in the form of a head part, which can be adjusted in relation to the base body 2. The pivot fitting 4 provided on the right side of the piece of seating furniture 1 serves to adjust the functional part 3 and is provided in the same way in a mirror-image on the left side of the piece of seating furniture 1 which is not illustrated.

In addition to the pivot fitting 4, a separate lift setting mechanism 5 is in each case provided which is connected to the pivot fitting 4 and prevents the functional part 3 from being inadvertently pivoted back again from a partly pivoted up position into the pivoted back starting position by the user resting his or her head on it. The lift setting mechanism 5 comprises a slender bar 6 which is guided on a guide 7 and can be moved in relation to the guide 7. In the case of the illustrated and in this respect preferred piece of seating furniture 1, the guide 7 is designed in the form of a housing, out of which the slender bar 6 can be pulled, in order to move the pivot fitting 4 and the functional part 3 from the pivoted back starting position illustrated in FIG. 1, namely towards a pivoted up position of the functional part 3.

In order to adjust the functional part 3, each pivot fitting 4 comprises a pivoted lever 8 which supports and pivots the functional part 3. The pivoted lever 8 is held by two adjusting levers 9, 10 which, in the case of the illustrated and in this respect preferred piece of seating furniture 1, extend vertically downwards and run approximately parallel to one another. One of the adjusting levers 9 is pivotably linked via a guide lever 11 to a support plate 12 which is connected to the base body 2. In addition, a control lever 13 is pivotably fixed to the support plate 12 and is connected to both adjusting levers 9, 10 which are spaced apart from one another. The connections of the support plate 12 to the guide lever 11 and to the control lever 13 are, in the case of the illustrated and in this respect preferred piece of seating furniture 1, designed as pivot connections 14 in the form of pivot joints. Similarly, the connections between the adjusting levers 9, 10 and the pivoted lever 8, on the one hand, and the guide lever 11 and the control lever 13, on the other hand, are designed as pivot connections 15, 16 in the form of pivot joints. Hence, the components of the pivot fitting 4 respectively connected together via the pivot connections 14, 15, 16 are in each case provided such that they are pivotable against one another and pivotable together with one another.

The pivot fitting 4 also defines two four-link chains. One of the four-link chains is formed by the adjusting levers 9, 10, the control lever 13 and the pivoted lever 8. The other four-link chain is formed by the guide lever 11, the control lever 13, the front adjusting lever 9, which is connected to the guide lever 11, and the support plate 12. In order to adjust the functional part 3 from the pivoted back position of the functional part 3 illustrated in FIGS. 1 and 3 into the pivoted up position of the functional part 3 illustrated in FIGS. 2 and 4, the user takes hold of the functional part 3 and moves it upwards and forwards. The slender bar 6 in the process is at least partly pulled out of the guide 7 which is in the form of a housing. The slender bar 6 of the lift setting mechanism 5 is connected to the rear adjusting lever 10 and is held on the rear adjusting lever 10. As a consequence, this adjusting lever 10 is lifted and hence also lifts the pivoted lever 8 connected to the adjusting lever 10. As a result, the functional part 3, in the form of a head part, as a whole is moved upwards. Alternatively, the lift setting mechanism 5 could also come into contact with the front adjusting lever 9 of the pivot fitting 4, in order to bring about a corresponding adjustment of the pivot fitting 4. The guide of the lift setting mechanism 5 is connected to the guide lever 11 and is pivotably held on it. Alternatively, however, the lift setting mechanism 5 could also be connected to the support plate 12. The lift setting mechanism 5 can also be directly connected to the base body 2 itself, although possibly less stably in terms of the connection.

The front adjusting lever 9 and the rear adjusting lever 10 also pivot the control lever 13, which is connected to the adjusting levers, upwards. In the process, the rear adjusting lever 10 is moved further upwards than the front adjusting lever 9. The adjusting levers 9, 10 can therefore take up a lower position in the pivoted back position of the functional part 3 and an upper position in the pivoted up position of the functional part 3. In the pivoted up position of the functional part 3 it is lifted and pivoted forwards, while the functional part 3 is lowered and pivoted backwards in the pivoted back position.

Since both adjusting levers 9, 10 spaced apart from one another pivotably come into contact with the pivoted lever 8 and the pivot connections 16 of the adjusting levers 9, 10 to the control lever 13 therefore have lever arms of different lengths together with the pivot connection 14 between the control lever 13 and the base body 2, the pivot fitting 8 is not only lifted but, at the same time, is pivoted forwards. The pivot connection 16 of the front adjusting lever 9 to the guide lever 11 fixed to the base body 2 ensures that the pivot fitting 4 during the described adjustment in each position of the functional part 3 can take up just one position (degree of freedom 1). In this way, it is ensured that a certain inclination of the functional part 3 belongs to each height of the functional part 3. In other words, it is ensured that pivoting always occurs in the same way.

Figure 2:
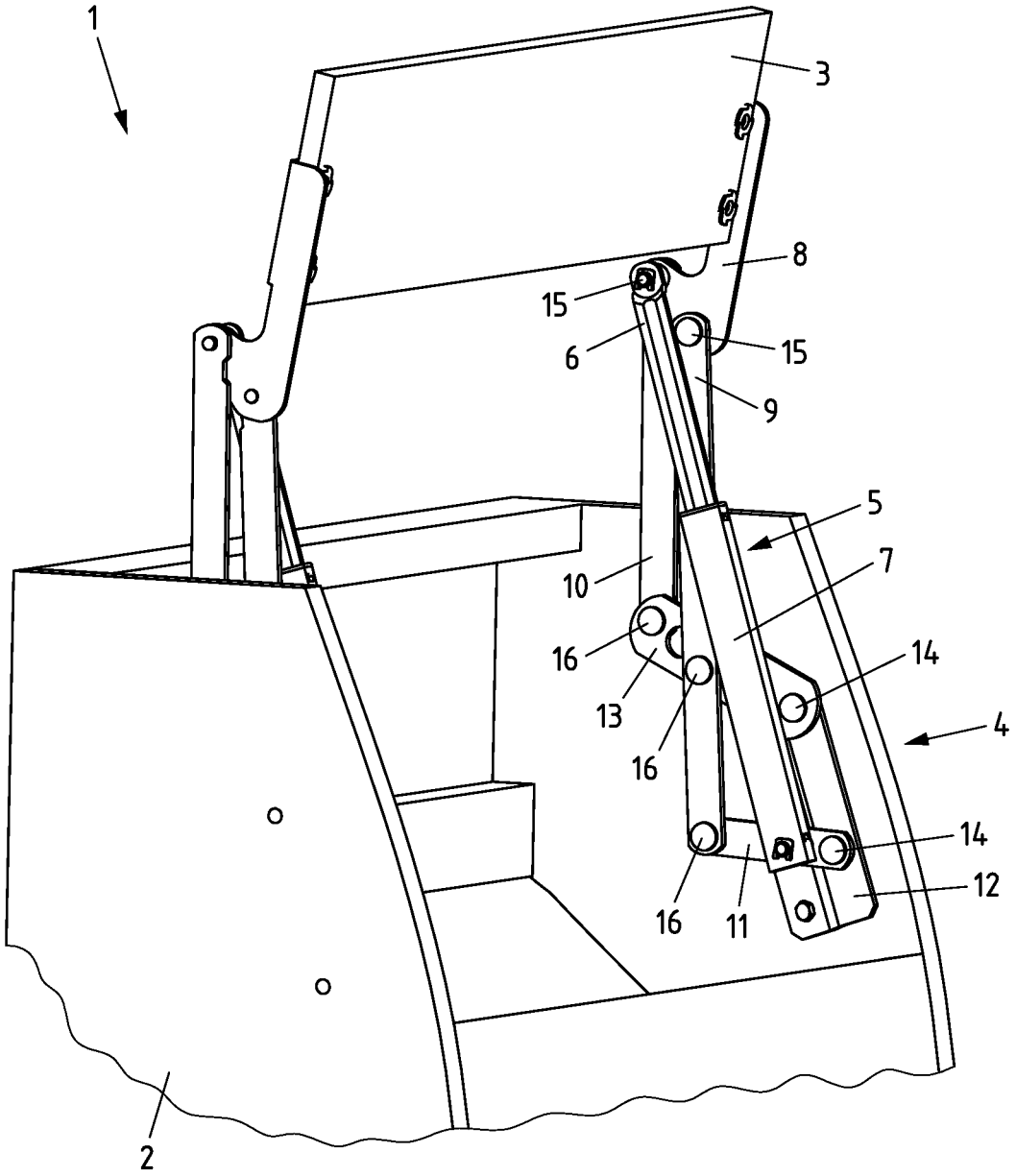
FIG. 2 shows the detail from FIG. 1 with the head part in a pivoted up position in a perspective view.
Figure 3:
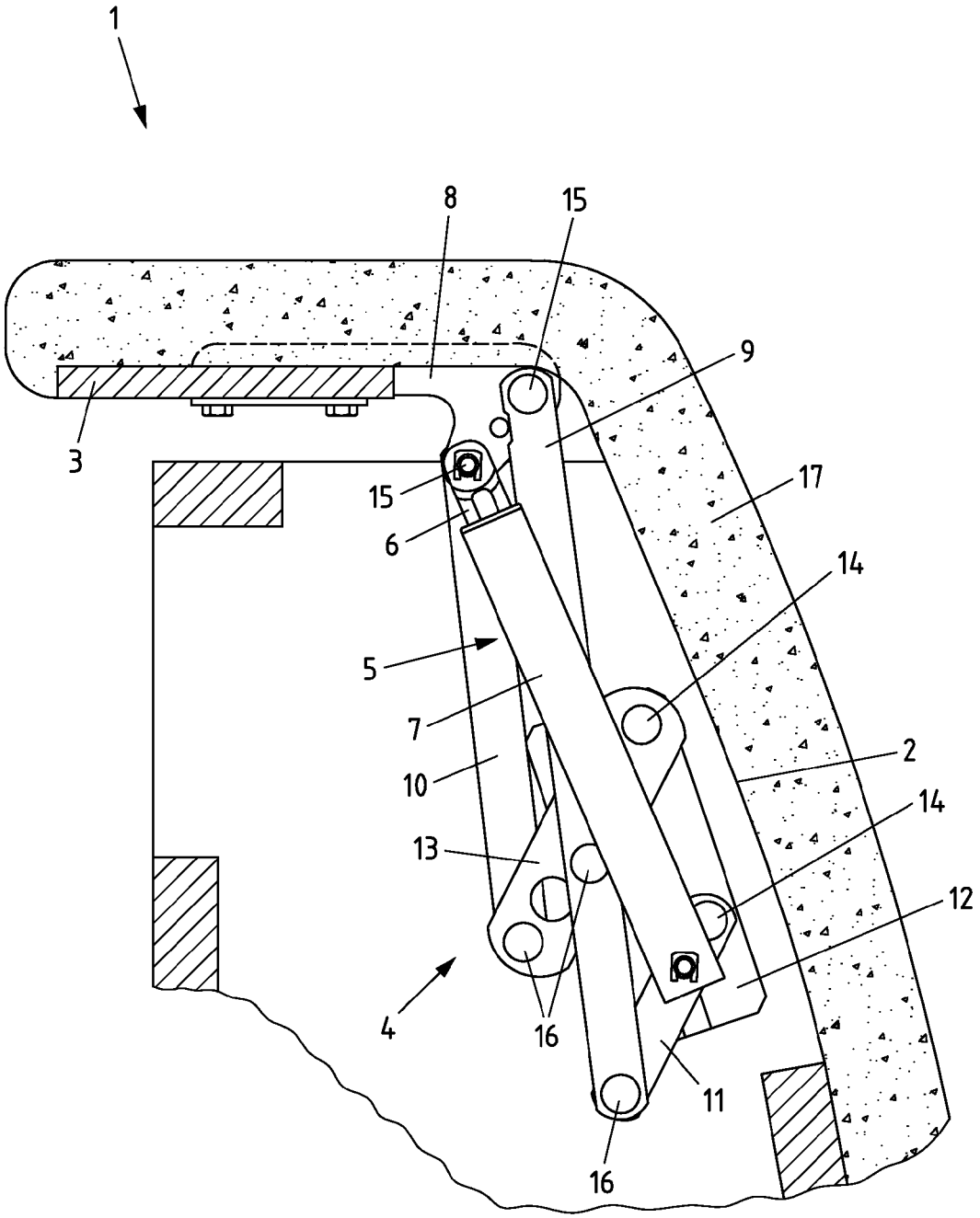
FIG. 3 shows the back rest and the head part of the piece of seating furniture from FIG. 1 with upholstery and a pivoted back head part in a side view.
Figure 4:
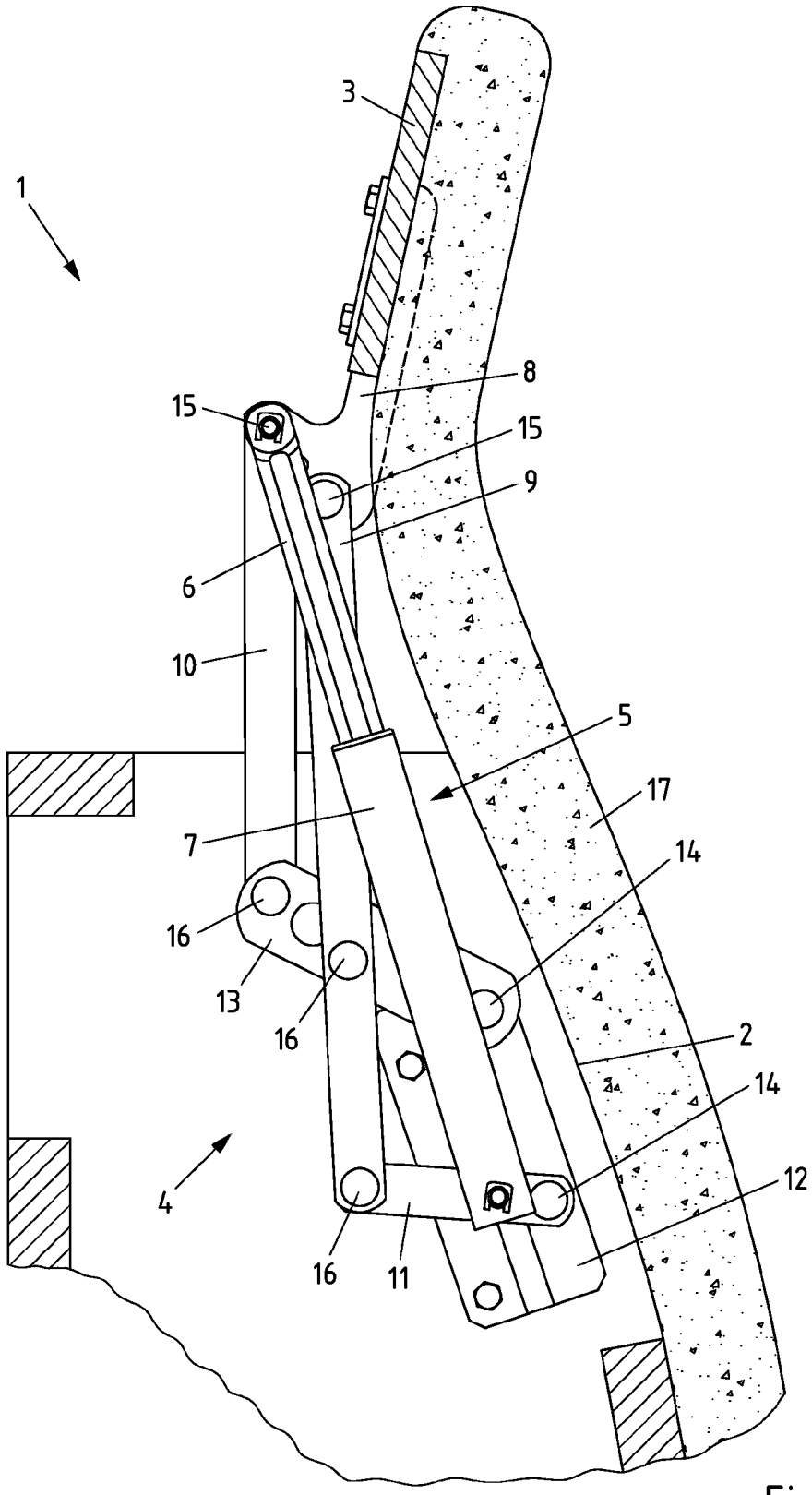
FIG. 4 shows the back rest and the head part from FIG. 3 with the pivoted up head part in a side view.

The functional part 3 can be pivoted as far as an end position in a pivoted up position according to FIGS. 2 and 4. From this end position, it can be pivoted back into the pivoted back position according to FIGS. 1 and 3. The pivot fitting 4 carries out the opposite movement while the slender bar 6 is moved downwards into the guide 7 of the lift setting mechanism 5. Since again the rear adjusting lever 10 is moved in the vertical direction by a larger amount than the front adjusting lever 9, the pivoted lever 8 and the functional part 3 are not only collectively lowered, but, at the same time, pivoted back, namely about a pivot axis between the contact points of the adjusting levers 9, 10 on the pivoted lever 8 in the form of the pivot connections 15.

Since adjusting the functional part 3 from the pivoted back position into the pivoted up position is accompanied by a lifting of the functional part 3, the upholstery 17 illustrated in FIGS. 3 and 4 is elongated, so that no excess material of the upholstery 17 arises which would crease. When the functional part 3 is pivoted back and at the same time the functional part 3 is lowered, in turn sufficient upholstery material is released, so that it is not overstretched or over-elongated at the transition from the base body 2 to the functional part 3.

The functional part 3 can only be adjusted from the end position illustrated in FIGS. 2 and 4 back into the other end position or starting position according to FIGS. 1 and 3. The functional part 3, on the other hand, cannot, or at best can only slightly, be pivoted back from an intermediate position into the corresponding direction, since this movement is then blocked by the lift setting mechanism 5. In this case, a wedge is produced between the slender bar 6 and the guide 7 of the lift setting mechanism 5. The corresponding wedging forces ensure that the slender bar 6 cannot be pushed further into the guide 7. As a result, the pivot fitting 4 can also not be pivoted further into the starting position according to FIGS. 1 and 3. Therefore, the functional part 3 is locked in the corresponding position, even if the user applies load to it. The functional part 3 inadvertently pivoting back is therefore prevented. The situation is different only if the functional part 3 is initially moved as far as the pivoted up end position and as a consequence thereof the slender bar 6 of the lift setting mechanism 5 is essentially fully pulled out in relation to the guide 7.

If the functional part 3, different from the illustrated piece of seating furniture 1, is formed as a foot part or as an arm rest, there is preferably a similar arrangement of the pivot fitting 4 and the lift setting mechanism 5 in relation to the functional part 3 and the base body 2 which can then be formed by a seat, a frame or a frame part, such as a side part. The arrangement and alignment of the pivot fitting 4 and the lift setting mechanism 5 in the piece of seating furniture 1 can then, however, differ and can be adapted to the connection of the functional part 3 to the base body 2 and to the function and desired adjustment of the functional part 3.

The functionality of the lift setting mechanism 5 and hence its effect in relation to the pivoting of the pivot fitting 4 of the illustrated and in this respect preferred piece of seating furniture 1 is explained in more detail with the aid of FIGS. 5 to 12.

Figure 5:
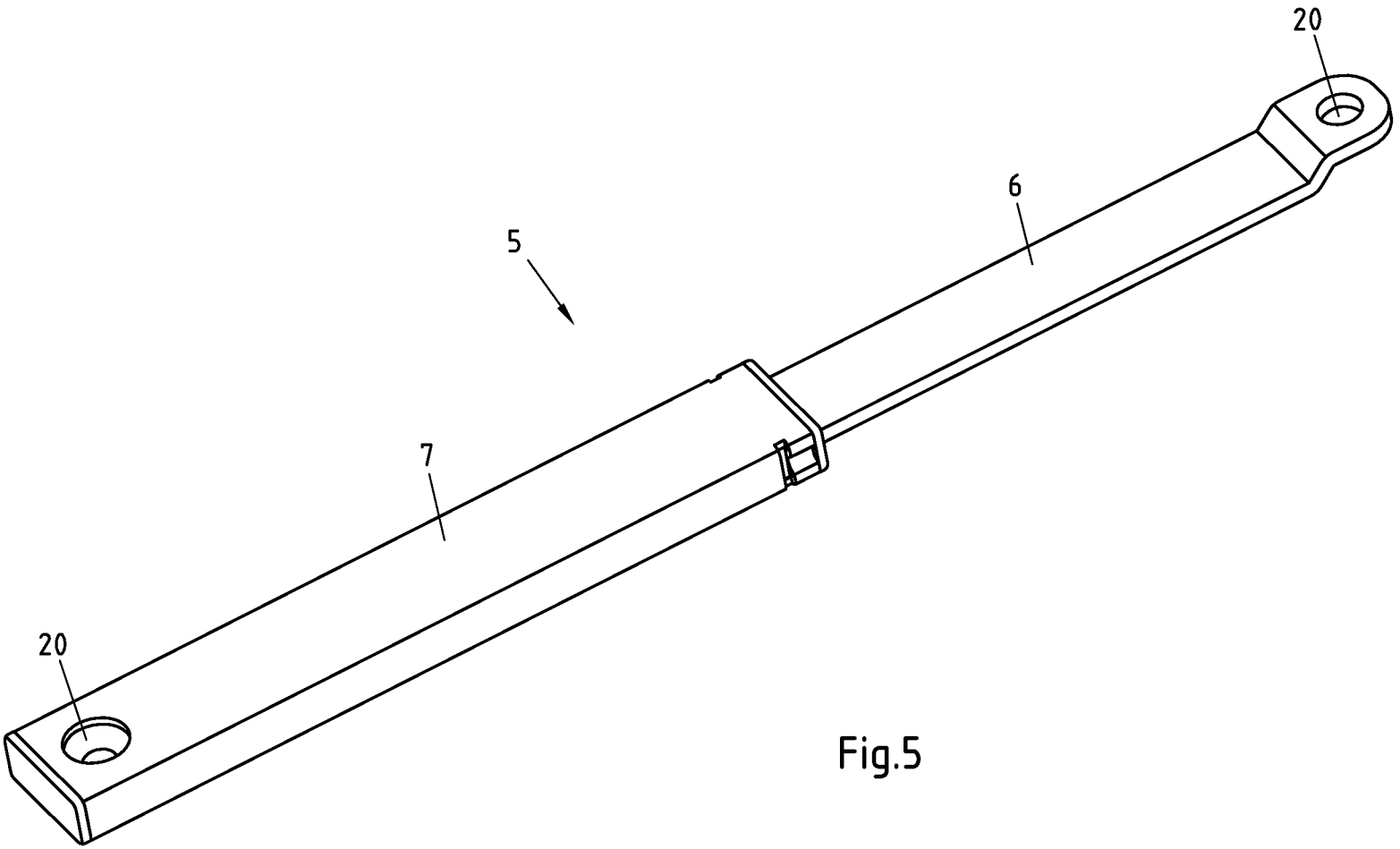
FIG. 5 shows a lift setting mechanism in a perspective view.

The lift setting mechanism 5 is illustrated in a perspective view in FIG. 5. The lift setting mechanism 5 comprises a through opening 20 on the rear end of the guide 7, which is designed in the form of a housing, and on the front end of the slender bar 6 respectively. The lift setting mechanism 5 is pivotably mounted on the pivot fitting 4 by means of the openings 20. In the case of the illustrated and in this respect preferred piece of furniture 1, the slender bar 6 is essentially strip-shaped, but could also, for example, be rod-shaped. In addition, the guide 7 of the lift setting mechanism 5 preferably has a corresponding, rectangular cross-section. The guide 7 is also designed in the form of an essentially closed housing as a protection against dirt.

Figure 6A:
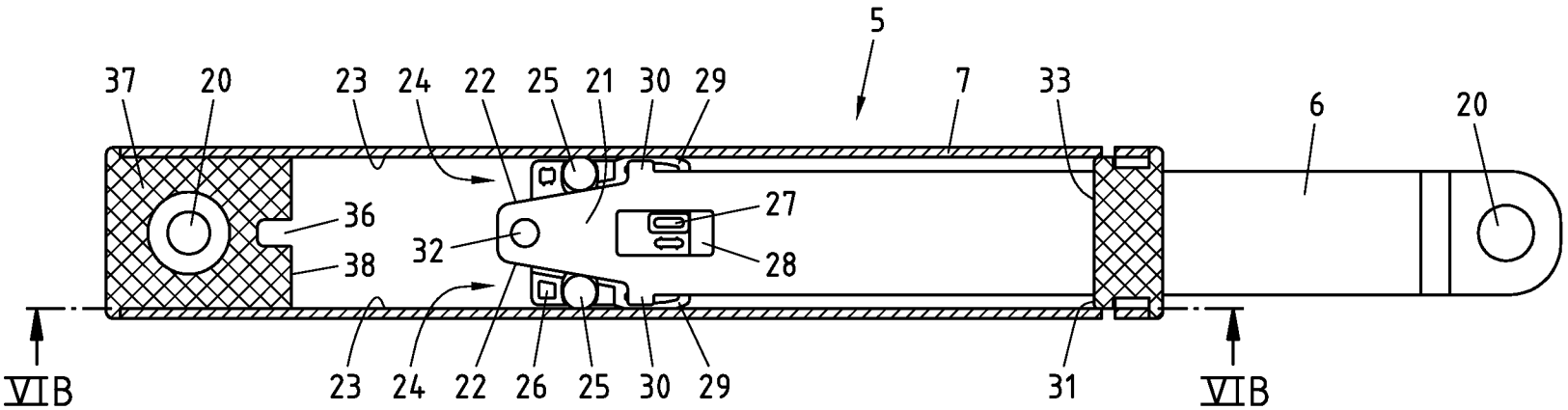
FIGS. 6A-B show the lift setting mechanism from FIG. 5 in a partly pulled-out position in a sectional view along the sections VIA-VIA and VIB-VIB.
Figure 6B:
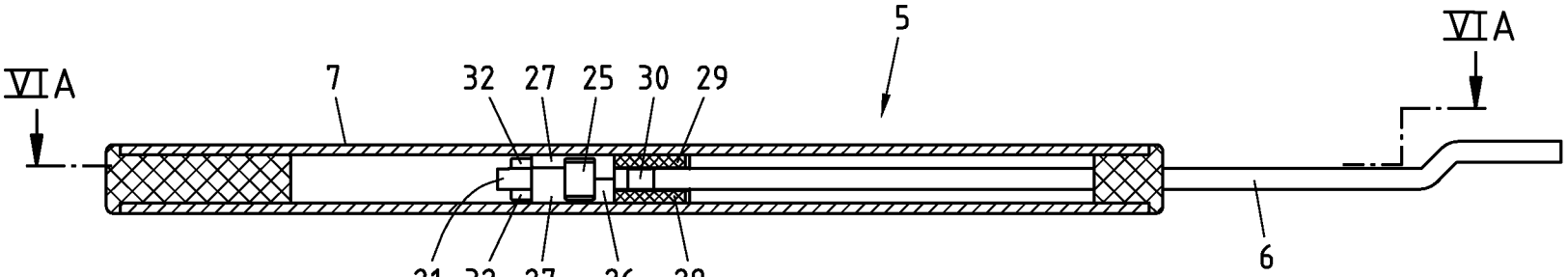

In FIGS. 6A and 6B, the lift setting mechanism 5 is illustrated in a partly pulled-out position in two sectional views arranged perpendicularly in relation to one another. The slender bar 6 has a tapered inner end 21. This end 21 correspondingly forms two outer surfaces 22 on the two narrow sides of the slender bar 6, these two outer surfaces 22 running obliquely to the opposing inner sides 23 of the guide 7 which in the case of the illustrated and in this respect preferred lift setting mechanism 5 are aligned parallel to one another and parallel to the pulling-out direction of the slender bar 6. Wedge gaps 24, in which wedge elements 25 are received, are correspondingly formed between the obliquely running surfaces 22 of the slender bar 6 and the opposing inner sides 23 of the guide 7. In the case of the illustrated and in this respect preferred lift setting mechanism 5, the surfaces 22 forming the wedge gaps 24 are flat and the wedge elements 25 have a cylindrical shape.

If the slender bar 6 is pressed into the guide 7 from the position illustrated in FIG. 6A, the lift setting mechanism 5 becomes blocked, since the wedge elements 25 on both sides of the slender bar 6 wedge into the wedge gaps 24 provided there. The wedge elements 25 can absorb wedging forces which are high enough for the slender bar 6 to become securely fixed in relation to the guide 7.

In the case of the illustrated and in this respect preferred lift setting mechanism 5, the wedge elements 25 are held in a wedge carriage 26 which in turn is held on the slender bar 6. The wedge carriage 26 is formed in two parts and encompasses the lower end of the slender bar 6. Fingers 27 of the wedge carriage engage with an elongated hole 28 of the slender bar 6, in order to mount the wedge carriage 26 such that it can move to a minor degree in relation to the slender bar 6. The wedge carriage 26 on two opposing sides also has friction strips 29 which abut on the inner sides 23 of the guide 7 interacting with the wedge elements 25. The static friction thereby caused ensures that the wedge carriage 26 tends to retain its position, if the wedge carriage 26 is freely movable in relation to the slender bar 6.

Lateral projections 30 of the slender bar 6 and the guide 7 form corresponding stop faces in the pulling-out direction, which together form an end stop 31 for the slender bar 6 and prevent the slender bar 6 from being pulled further out of the guide 7. A further adjustment of the pivot fitting 4 connected to the lift setting mechanism 5 is also thereby prevented.

Figure 7:
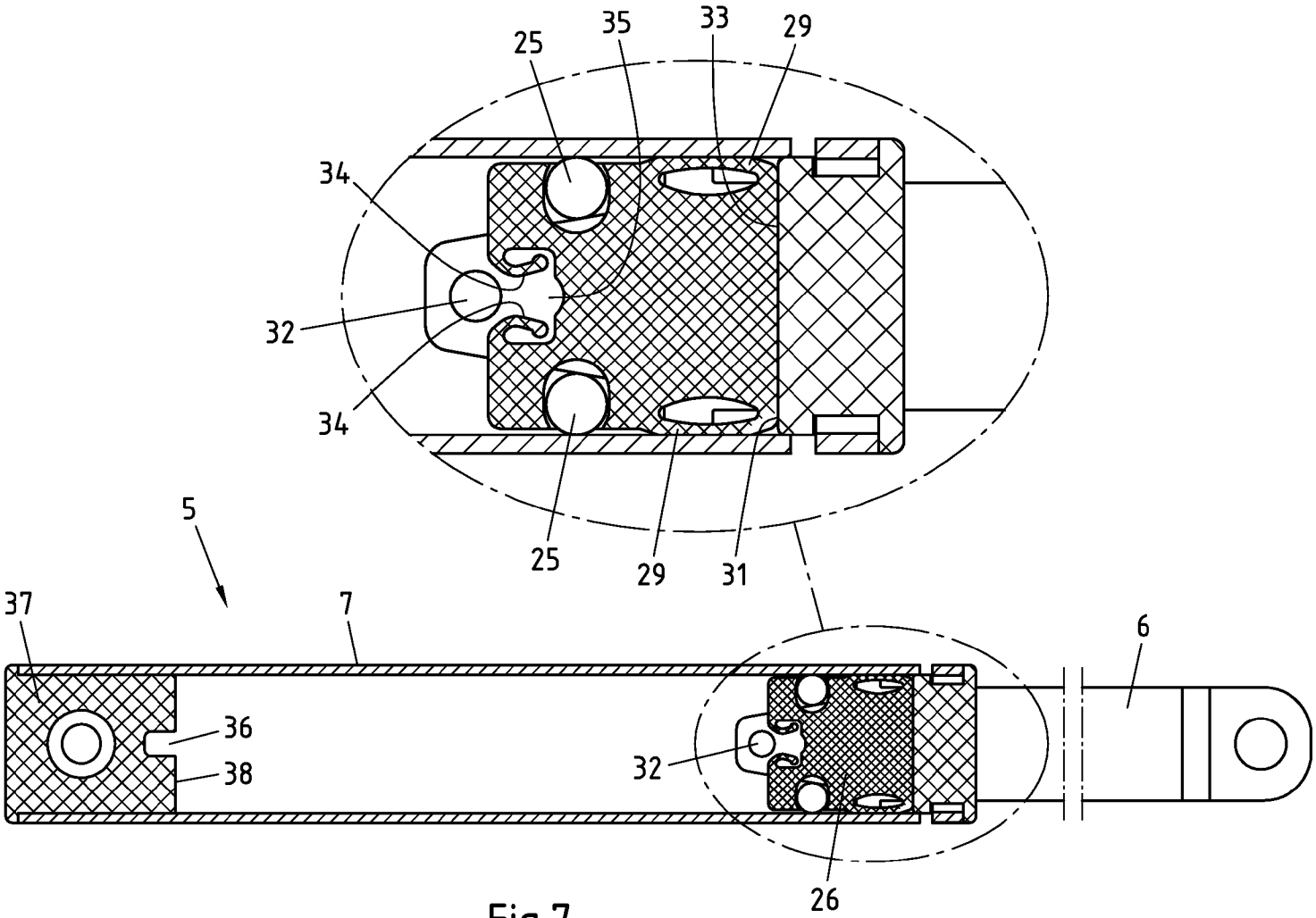
FIG. 7 shows the lift setting mechanism from FIG. 5 in an almost fully pulled-out position in a longitudinal section.

If the slender bar 6 from the position illustrated in FIG. 6A is pulled further out of the guide 7, the lift setting mechanism 5 reaches the position illustrated in FIG. 7, in which the slender bar 6 is pulled out of the guide 7 almost as far as an end position. The wedge carriage 26, which abuts on the lugs 32 of the slender bar 6, has as a result been moved to an end stop 33 for the wedge carriage 26. This end stop 33 restricts the further movement of the wedge carriage 26 in the pulling-out direction of the slender bar 6.

Figure 8:
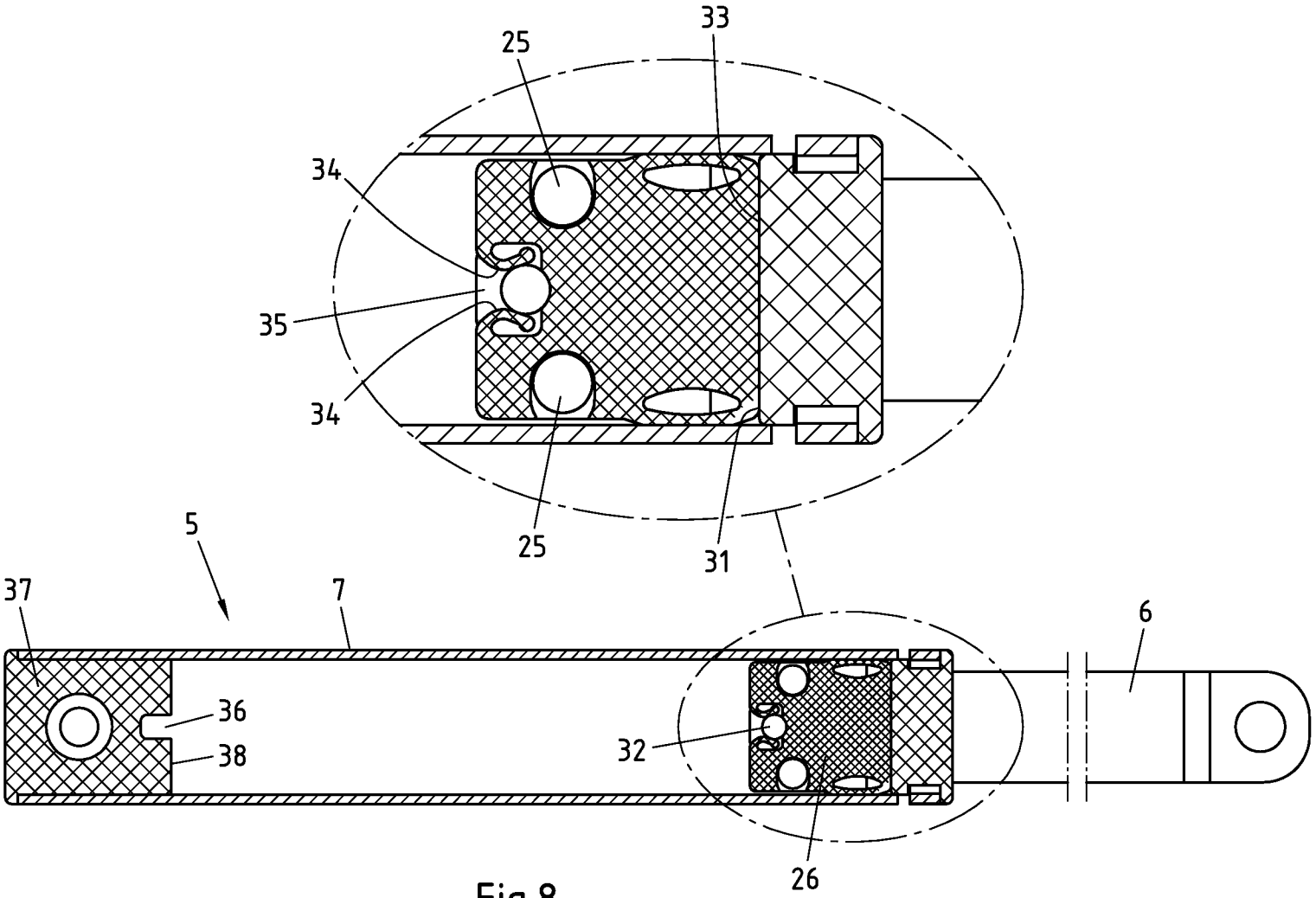
FIG. 8 shows the lift setting mechanism from FIG. 5 in a pulled-out end position in a longitudinal section.

If the slender bar 6 is then pulled further out of the guide 7 into the position illustrated in FIG. 8, the lugs 32 of the slender bar 6 slip past the strip-shaped connection elements 34 of the wedge carriage 26, whereupon the connection elements 34 engage behind the lugs 32 and, in this way, form a separate connection between the slender bar 6 and the wedge carriage 26. The lugs 32 are received in corresponding receiving slots 35 of the wedge carriage 26. This is in particular illustrated in FIG. 4. The wedge carriage 26 is now connected to the slender bar 6 in a position, in which the wedge elements 25 cannot reach into the wedge gaps 24 to wedge there. Therefore, the slender bar 6 can be pushed into the guide 7 without a great exertion of force.

In order to detach the separate connection between the wedge carriage 26 and the slender bar 6 again, the slender bar 6 must be pushed into a starting position in relation to the guide 7. Then, the lugs 32 of the slender bar 6 engage with a free space 36 in the base 37 of the guide 7. Before the slender bar 6 reaches this starting position, the wedge carriage 26 comes into contact with the base 37 of the guide 7. The base 37 in this way forms a start stop 38 for the wedge carriage 26. The wedge carriage 26 is held in this position, while the slender bar 6 can be pushed further into the guide 7. In the process, the lugs 32 of the slender bar 6 are pushed past the connection elements 34 of the wedge carriage 26 and the form-fit latching connection between the slender bar 6 and the wedge carriage 26 becomes detached. The lugs 32 of the slender bar are then no longer held in the corresponding receiving slots 35 of the wedge carriage 26. The slender bar 6 can therefore be partly pulled out again and, at the same time, carry the wedge carriage 26 with it, in order to counteract again in the corresponding position the slender bar 6 being once more pushed in. In order to be able to push the slender bar 6 into the starting position in the guide 7 again, the slender bar 6 must firstly again as described be pulled out as far as the end position, so that in this way the wedge carriage 26 is fixed on the slender bar 6 via the separate latching connection.

Figure 9:
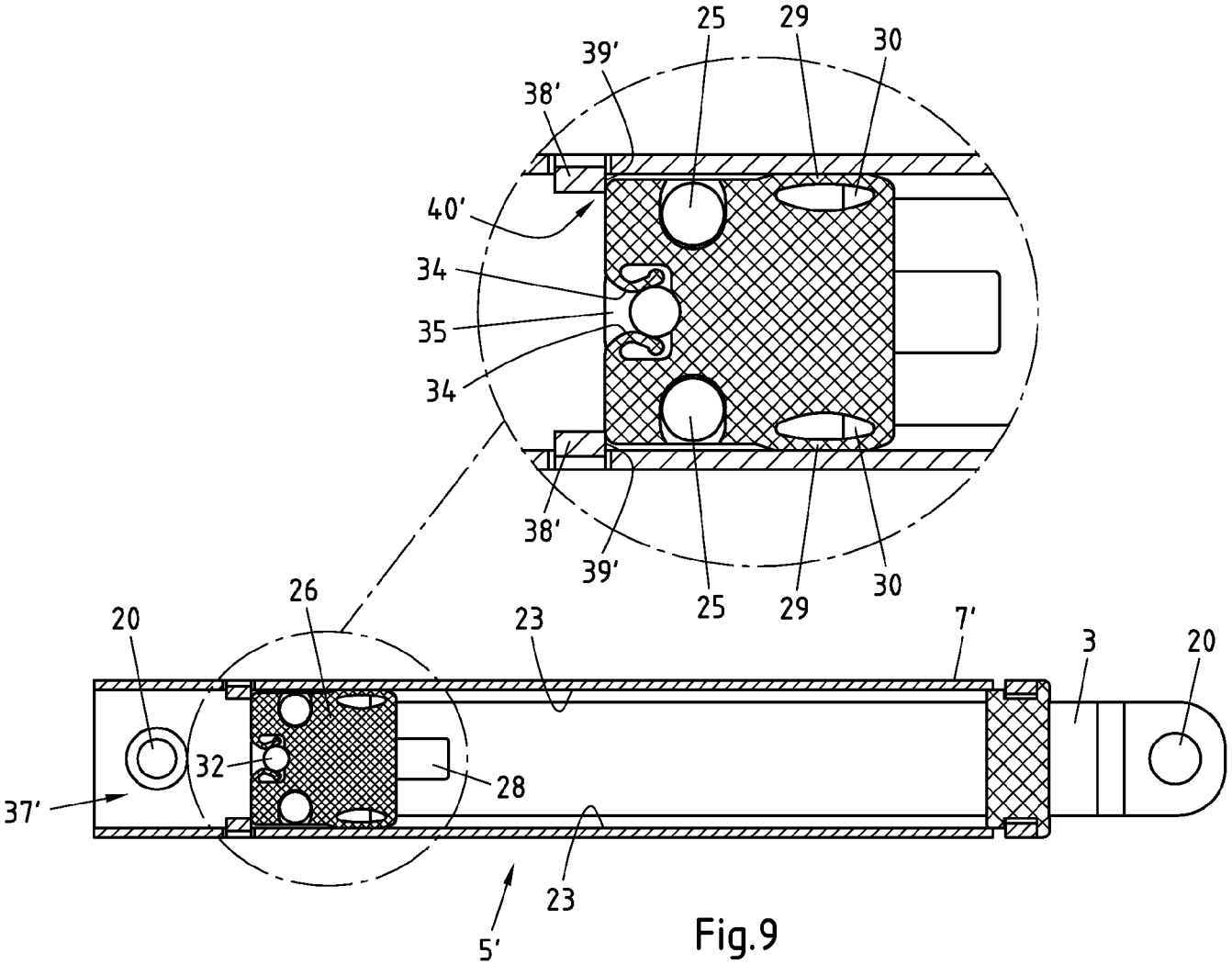
FIG. 9 shows an alternative lift setting mechanism in an almost fully pushed-in position in a longitudinal section and FIG. 10 shows the lift setting mechanism from FIG. 9 in a pushed-in starting position in a longitudinal section.
Figure 10:
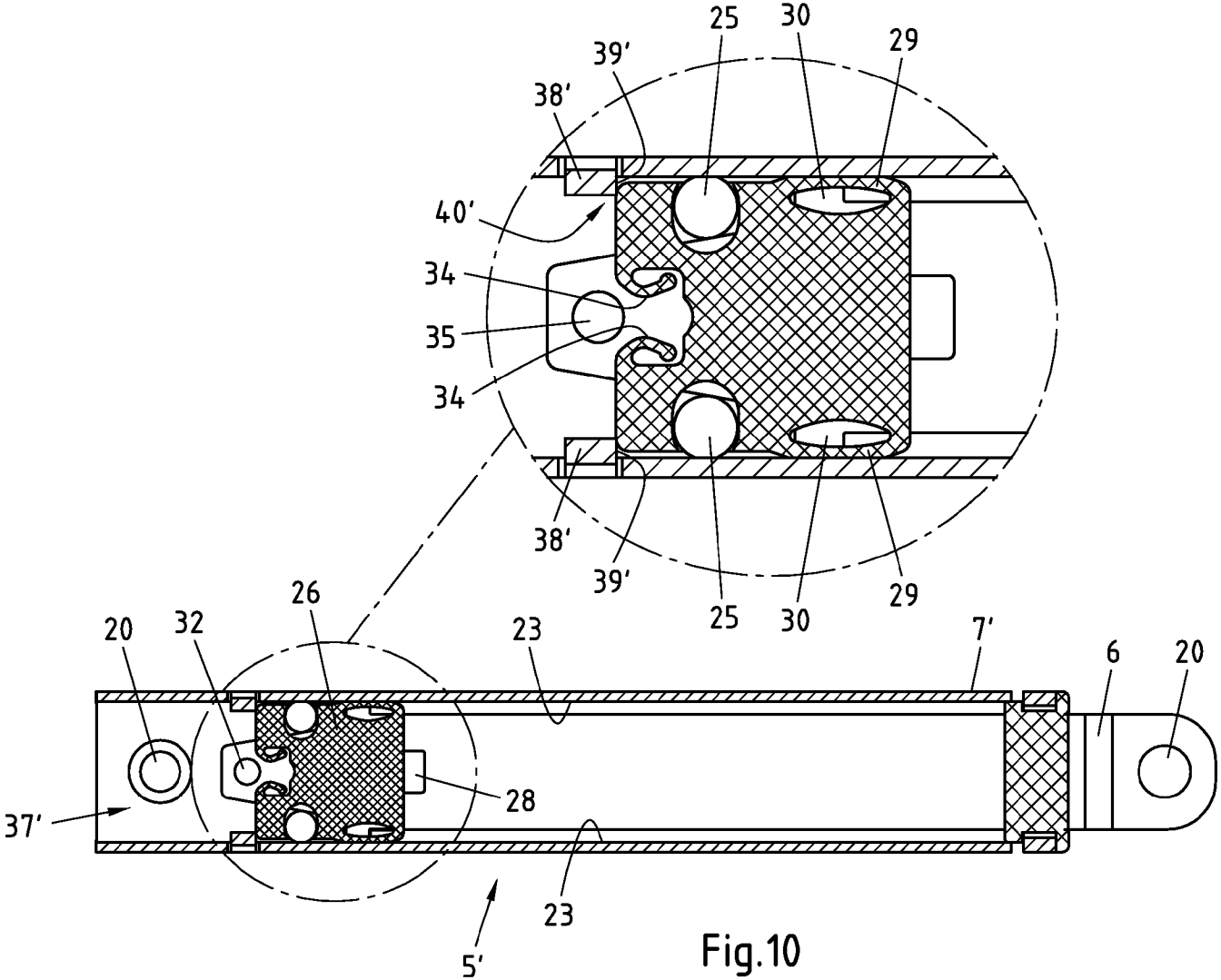

An alternative lift setting mechanism 5' is illustrated in FIGS. 9 and 10. This only differs from the lift setting mechanism 5 in FIGS. 5 to 8 by the design of the base 37' and is also illustrated in a longitudinal section.

The base 37' of the lift setting mechanism 5' has two edge elements 38' of the guide 7' which are pushed inwards and provide the stop faces 39' pointing in the pulling-out direction. The stop faces 39' form a start stop 40' for the wedge carriage 26. Instead of edge elements 38' of the guide 7' which are pushed inwards, the stop faces 39' could also be provided by another stop element.

If the slender bar 6 connected to the wedge carriage 26 via the already described separate connection is pushed in towards its starting position in relation to the guide 7', the wedge carriage 26 firstly reaches a start stop 40' defined by the stop faces 39'. The wedge carriage 26 is held in this position, while the slender bar 6 can be pushed in further in relation to the guide 7'. By means of the corresponding relative movement between the slender bar 6 and the wedge carriage 26, the lugs 32 of the slender bar 6 are pushed past the connection elements 34 of the wedge carrier 26 out of the receiving slot 35 of the same and, in the process, the separate connection between the wedge carriage 26 and the slender bar 6 is detached. Nevertheless, the wedge carriage 26 remains held on the slender bar 6 further movable in relation to the slender bar 6, so that, on the one hand, the slender bar 6 can be pulled out again and, on the other hand, the wedge elements 25 always prevent the slender bar 6 from being inadvertently pushed back in relation to the guide 7', as has already been basically described. Connection of the detachable connection between the slender bar 6 and the wedge carriage 26 when pulling the slender bar 6 out in relation to the guide 7' also takes place as already previously described.

In the case of the illustrated and in this respect preferred piece of seating furniture 1, in which the functional part 3 is formed as a head part and the base body 2 is formed as a back rest, both the pivot fitting 4 and the lift setting mechanism 5 are aligned essentially vertically. However, a horizontal alignment of the pivot fitting and the lift setting mechanism is also possible, namely particularly with a functional part in the form of a foot part and a base body in the form of a seat. Then, for example, the functional part can be pivoted from a lower rather vertical position into an upper rather horizontal position and back.

The invention claimed is:

1. A piece of seating furniture comprising:

at least one base body, at least one adjustable functional part, at least one pivot fitting for adjusting the functional part relative to the base body and a lift setting mechanism for locking the functional part in relation to the base body, wherein the lift setting mechanism has a guide and a slender bar which can be moved in relation to the guide, each of the guide and the slender bar pivotally connected to the pivot fitting, wherein the lift setting mechanism is configured to be moved from one of a plurality of set positions, each set position comprising an at least partially retracted position of the guide relative to the slender bar, each set position blocking the adjustment of the functional part relative to the base body in a load direction in a form-fit or wedging manner by at least one wedge element engaging an inner wall of the guide at any of the plurality of set positions, to a reset position comprising a protracted position of the guide relative to the slender bar, the reset position unblocking the adjustment of the functional part relative to the base body in the load direction, wherein the functional part is supported by a pivoted lever of the pivot fitting, wherein the pivoted lever is pivotably connected to the base body separately via two adjusting levers, wherein the two adjusting levers are jointly connected to the base body via a control lever, and wherein at least one of the adjusting levers is pivotably connected to the base body via a guide lever.

2. The piece of seating furniture according to claim 1, wherein the lift setting mechanism has a latching element which is spring-loaded, and wherein the latching element forms a latching connection with at least one receiving slot of the guide, the latching connection blocking the adjustment of the functional part in the load direction in a form-fit manner.

3. The piece of seating furniture according to claim 2, wherein the latching element can be deactivated by moving the slender bar in relation to the guide into one end position and can be activated by moving the slender bar in relation to the guide into a separate end position.

4. The piece of seating furniture according to claim 1, wherein the at least one wedge element is movable between a wedging position and at least one adjustment position in relation to the slender bar, and wherein in the wedging position the at least one wedge element is held wedged in a wedge gap between the slender bar and the guide in such a way that movement of the slender bar in relation to the guide in a retracting direction is prevented.

5. The piece of seating furniture according to claim 4, wherein the wedge gap tapers in the retracting direction and that the wedge element is wedged in the wedging position between one tapered end of the slender bar and the guide.

6. The piece of seating furniture according to claim 4, wherein a wedge carriage is provided comprising the at least one wedge element, the wedge carriage movable in relation to the slender bar and held by engagement of at least a portion of the wedge carriage in an elongated hole of the slender bar.

7. The piece of seating furniture according to claim 4, wherein a detachable connection between the slender bar and the wedge element or the wedge carriage is provided in such a way that the detachable connection can be locked, preferably in a latching or wedging manner, by moving the slender bar in relation to the guide into a connection position.

8. The piece of seating furniture according to claim 4, wherein a detachable connection between the slender bar and the wedge element or the wedge carriage is provided in such a way that the detachable connection can be detached by moving the slender bar in relation to the guide into fully retracted position, by abutting the wedge element or the wedge carriage on a start stop.

9. The piece of seating furniture according to claim 4, wherein the lift setting mechanism further comprises a plurality of wedge elements, including the at least one wedge element, wherein at least one of the wedge elements or the wedge carriage abut at least in sections in a frictionally engaged manner on the guide.

10. The piece of seating furniture according to claim 1, wherein the slender bar is continuously adjustable along the guide.

11. The piece of seating furniture according to claim 1, wherein the pivoted lever can be pivoted about a pivot axis, and wherein the pivot axis is located essentially centrally between the contact points of the adjusting levers on the pivoted lever.

12. The piece of seating furniture according to claim 1, wherein the guide lever, the control lever, the adjusting lever, which is connected to the guide lever, and the support plate form a four-link chain, or wherein the two adjusting levers, the control lever and the pivoted lever form a four-link chain, and wherein the lift setting mechanism comes into contact with at least one of the adjusting levers.

13. The piece of seating furniture according to claim 1, wherein at least the adjusting levers, the pivoted lever, the guide lever and the control lever form a pivot fitting, and wherein the pivot fitting has a degree of freedom of 1.

14. The piece of seating furniture according to claim 1, wherein one of the adjusting levers is connected to at least one of the pivoted lever, the control lever and the guide lever in each case via a pivot joint, and wherein the other of the adjusting levers is connected to at least one of the pivoted lever and the control lever in each case via a pivot joint, and wherein the guide lever and the control lever are jointly held on the base body by a support plate.

* * * * *